US010437182B2

(12) United States Patent
Urano

(10) Patent No.: US 10,437,182 B2
(45) Date of Patent: Oct. 8, 2019

(54) IMAGE FORMING APPARATUS AND CONTROL METHOD OF IMAGE FORMING APPARATUS

(71) Applicant: KONICA MINOLTA, INC., Tokyo (JP)

(72) Inventor: Etsuaki Urano, Okazaki (JP)

(73) Assignee: Konica Minolta, Inc., Chiyoda-ku, Tokyo (JP)

( * ) Notice: Subject to any disclaimer, the term of this patent is extended or adjusted under 35 U.S.C. 154(b) by 0 days.

(21) Appl. No.: 16/157,526

(22) Filed: Oct. 11, 2018

(65) Prior Publication Data

US 2019/0137911 A1 May 9, 2019

(30) Foreign Application Priority Data

Nov. 8, 2017 (JP) ..... 2017-215503

(51) Int. Cl.
*G03G 15/20* (2006.01)

(52) U.S. Cl.
CPC ..... *G03G 15/2025* (2013.01); *G03G 15/2053* (2013.01); *G03G 2215/00531* (2013.01)

(58) Field of Classification Search
CPC ..... G03G 15/2025; G03G 2215/00531
See application file for complete search history.

(56) References Cited

U.S. PATENT DOCUMENTS 5,865,121 A * 2/1999 Testardi ..... G03G 15/2025 101/425
2008/0138127 A1* 6/2008 Son ..... G03G 15/2014 399/327
2009/0257793 A1* 10/2009 Yoshioka ..... G03G 15/6573 399/321

FOREIGN PATENT DOCUMENTS

JP 2010262186 A * 11/2010
JP 2012133034 A 7/2012

OTHER PUBLICATIONS

Machine Translation of Imaizumi (JP2010262186). Nov. 2010 (Year: 2010).*

* cited by examiner

*Primary Examiner* — Carla J Therrien
(74) *Attorney, Agent, or Firm* — Buchanan Ingersoll & Rooney PC

(57) ABSTRACT

An image forming apparatus includes: a fixing apparatus including a heating member that is heated by a heater and a pressure member that forms a fixing nip between the pressure member and the heating member by pressing the heating member; and a supplier that, when toner images of a plurality of images including non-image regions overlapping each other are consecutively fixed by the fixing apparatus, supplies a cleaning sheet on which a cleaning image is formed on one surface, to the fixing nip in a state where the one surface faces the pressure member, wherein the non-image regions are regions extending along the conveyance direction from an upstream side end in the conveyance direction in an image to a downstream side end in the conveyance direction, and not including a toner image having a length of equal to or more than a first value in the conveyance direction.

14 Claims, 13 Drawing Sheets

IMAGE FORMING APPARATUS AND CONTROL METHOD OF IMAGE FORMING APPARATUS

The entire disclosure of Japanese patent Application No. 2017-215503, filed on Nov. 8, 2017, is incorporated herein by reference in its entirety.

BACKGROUND

Technological Field

The present invention relates to an image forming apparatus and a control method of the image forming apparatus. More specifically, the present invention relates to an image forming apparatus including a fixing apparatus for fixing a toner image on a sheet, and a control method of the image forming apparatus.

Description of the Related Art

Examples of an electrophotographic image forming apparatus include a multi function peripheral (MFP) including a seamier function, a facsimile function, a copying function, a function as a printer, a data communication function, and a server function, a facsimile machine, a copying machine, a printer, and the like.

An image forming apparatus forms an image on a sheet generally by the following method. The image forming apparatus forms an electrostatic latent image on an image carrier and develops the electrostatic latent image using a developing apparatus to form a toner image. Next, the image forming apparatus transfers the toner image to the sheet, and fixes the toner image on the sheet by the fixing apparatus. Some image forming apparatuses form a toner image on a photoreceptor, transfer the toner image to an intermediate transfer belt using a primary transfer roller, and secondarily transfer the toner image on the intermediate transfer belt to a sheet using a secondary transfer roller.

The fixing apparatus includes a heating member that is heated by a heater and a pressure member that forms a fixing nip between the pressure member and the heating member by pressing the heating member. The heating member comes into contact with a front side of the sheet (a surface on which the toner image to be fixed is formed). The pressure member comes into contact with a back side of the sheet (a surface opposite from the surface on which the toner image to be fixed is formed).

As a technique relating to a fixing apparatus, for example, JP 2012-133034 A or the like discloses a technique for preventing scratches from being generated on a surface layer of a fixing roller due to adhesion of sheet dust to the surface layer of the fixing, roller. JP 2012-133034 A discloses a technique of forming a cleaning image pattern for removing foreign matters adhered to a heating member, in a tip end margin portion or a rear end margin portion of a sheet in a conveyance direction, and heating this sheet by a fixing apparatus. In this technique, the number of image dots in the sheet conveyance direction is counted and integrated, the length in the conveyance direction of the sheet passing through the fixing apparatus is counted and integrated. When a count value of the number of dots with respect to a count value of the length of the sheet in the conveyance direction is equal to or less than a preset set value, the cleaning image pattern is formed in the margin portion in the sheet conveyance direction at the position corresponding to the number of dots that is equal to or less than the set value.

The inventors of the present application have found that, when the identical images are consecutively printed on a plurality of sheets, linear stains along a Sheet conveyance direction are generated on a surface of a pressure member, the stains are transferred also to a heating member, as a result, the stains adhere to both surfaces of the sheet, and the image quality deteriorates.

In recent years, types of sheet used in an image forming apparatus are diverse. Among areas where an image forming apparatus is used, there are areas where a sheet with high whiteness is preferably used. As a method for improving whiteness of a sheet, there are a method of bleaching pulp, a method of increasing calcium carbonate contained in raw materials, and the like. From the viewpoint of cost reduction of a sheet, as a method for improving whiteness of a sheet, there is a tendency to employ the method of increasing calcium carbonate rather than the method of bleaching. The deterioration in image quality described above is conspicuous particularly when printing is performed using a sheet prepared by increasing calcium carbonate.

SUMMARY

The present invention is for solving the problem described above and an object of the present invention is to provide an image forming apparatus and a control method of the image forming apparatus capable of suppressing degradation of image quality.

To achieve the abovementioned object, according to an aspect of the present invention, an image forming apparatus reflecting one aspect of the present invention comprises: a fixing apparatus comprising a heating member that is heated by a heater and a pressure member that forms a fixing nip between the pressure member and the heating member by pressing the heating member, the fixing apparatus conveying a sheet on which a toner image is formed in a predetermined conveyance direction while gripping the sheet with the fixing nip to fix the toner image on the sheet; and a supplier that, when toner images of a plurality of images including non-image regions overlapping each other are consecutively fixed by the fixing apparatus, supplies a cleaning sheet on which a cleaning image is formed on one surface, to the fixing nip in a state where the one surface faces the pressure member, the cleaning image including the toner image at least in a part of a region corresponding to the non-image regions overlapping each other, wherein the non-image regions are regions extending along the conveyance direction from an upstream side end in the conveyance direction in an image to a downstream side end in the conveyance direction, and not including a toner image having a length of equal to or more than a first value in the conveyance direction.

BRIEF DESCRIPTION OF THE DRAWINGS

The advantages and features provided by one or more embodiments of the invention will become more fully understood from the detailed description given hereinbelow and the appended drawings which are given by way of illustration only, and thus are not intended as a definition of the limits of the present invention:

FIGS. 8A and 5B are diagrams showing an example of a relationship between the non-image region position data and a cleaning image of a cleaning sheet;

DETAILED DESCRIPTION OF EMBODIMENTS

Hereinafter, one or more embodiments of the present invention will be described with reference to the drawings. However, the scope of the invention is not limited to the disclosed embodiments.

In the following embodiments, a case where an image forming apparatus is an MFP will be described. The image forming apparatus may be a facsimile machine, a copying machine, a printer, or the like, in addition to the MFP.

First Embodiment

First, a configuration of an image forming apparatus in the present embodiment will be described.

Figure 1:
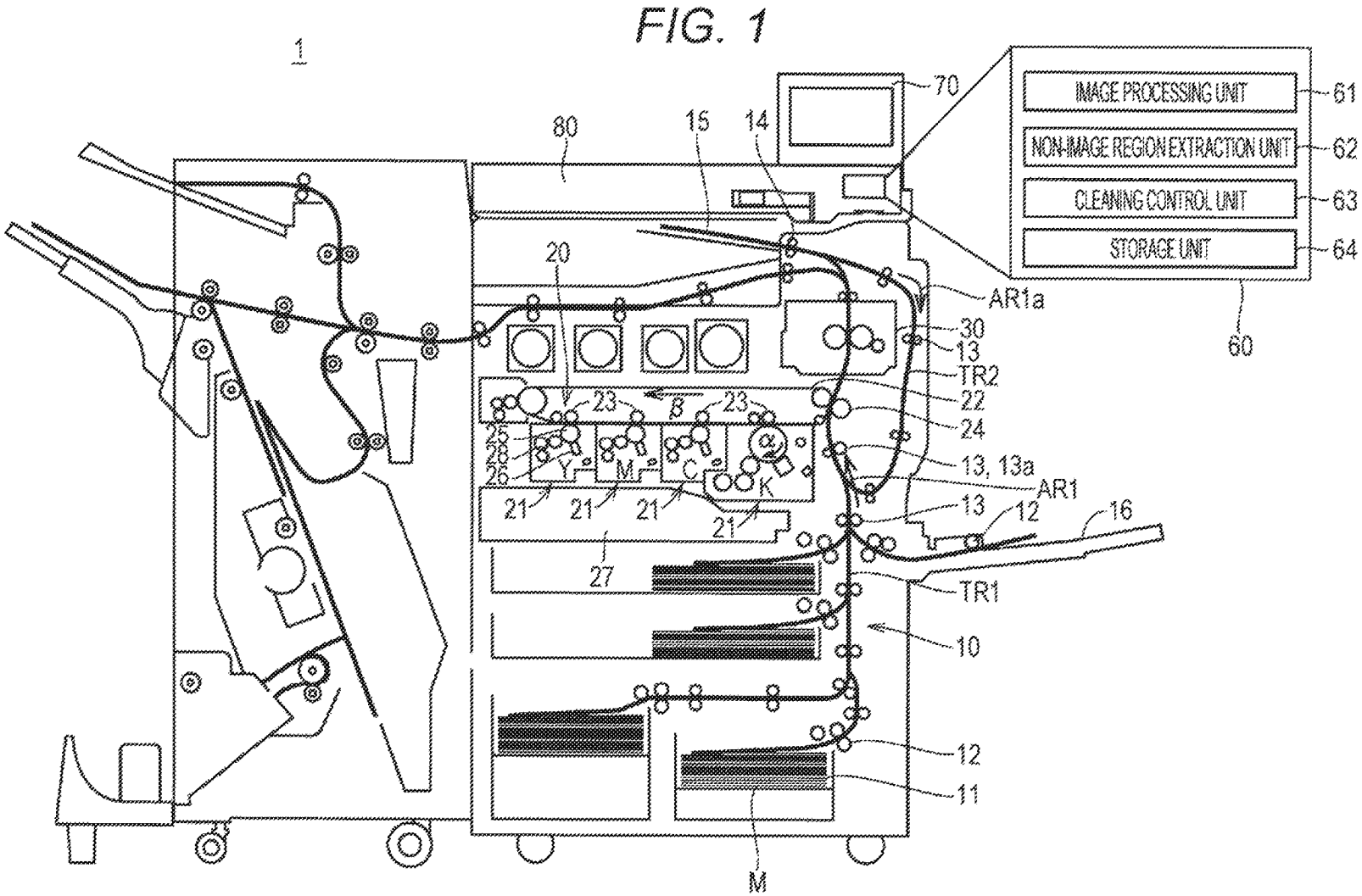
FIG. 1 is a cross-sectional view showing a configuration of an image forming apparatus according to a first embodiment of the present invention.

FIG. 1 is a cross-sectional view showing a configuration of an image forming apparatus 1 according to a first embodiment of the present invention.

Referring to FIG. 1, the image forming apparatus 1 according to the present embodiment is an electrophotographic full-color MFP and mainly includes a sheet conveyance unit 10, a toner image forming unit 20, a fixing apparatus 30, a control unit 60, an operation panel 70, and an image reading unit 80.

The sheet conveyance unit 10 conveys a sheet M along conveyance paths TR1 and TR2. The sheet conveyance unit 10 includes a sheet feed tray 11, a sheet feed roller 12, a plurality of conveyance rollers 13, a sheet discharge roller 14, a sheet discharge tray (sheet accommodation unit) 15, and a manual feed tray 16. The sheet feed tray 11 accommodates the sheet M (an example of a recording material) for forming an image. A plurality of sheet feed trays 11 may be used. The sheet feed roller 12 is provided between each of the sheet feed tray 11 and the manual feed tray 16 and the conveyance path TR1. Each of the plurality of conveyance rollers 13 is provided along the conveyance paths TR1 and TR2. The sheet discharge roller 14 is provided at the most downstream portion of the conveyance path TR1. The sheet discharge tray 15 is provided at the top of a main body of the image forming apparatus. The manual feed tray 16 is attached to a side surface of the main body of the image forming apparatus 1 and is used for placing a manual feed sheet or a cleaning sheet which will be described later.

The toner image forming unit 20 composes images of four colors of yellow (Y), magenta (M), cyan (C), and black (K) by a so-called tandem system to form a toner image on a sheet. The toner image forming unit 20 includes an image forming unit 21 for each color of Y, M, C, and K, an intermediate transfer belt 22, a primary transfer roller 23 for each color of Y, M, C, and K, a secondary transfer roller 24, and an exposure apparatus 27.

The image forming unit 21 for each color of Y, M, C, and K includes a photosensitive drum 25, a charging roller 26, a developing apparatus 28, and the like. The photosensitive drum 25 is driven to rotate in a direction indicated by an arrow $\alpha$ in FIG. 1. The charging roller 26 and the developing apparatus 28 are provided around the photosensitive drum 25. The charging roller 26 is provided in proximity to the photosensitive drum 25.

The intermediate transfer belt 22 is provided above the image forming unit 21 for each color of Y, M, C, and K. The intermediate transfer belt 22 is annular and spans a rotating roller. The intermediate transfer belt 22 is driven to rotate in a direction indicated by an arrow $\beta$ in FIG. 1. Each primary transfer roller 23 faces each photosensitive drum 25 with the intermediate transfer belt 22 interposed therebetween. The secondary transfer roller 24 is in contact with the intermediate transfer belt 22 in the conveyance path TR1. The exposure apparatus 27 is provided under the image forming unit 21.

The fixing apparatus 30 fixes a toner image on a sheet by conveying the sheet carrying the toner image along the conveyance path TR1 while gripping the sheet.

The control unit 60 controls the overall operation of the image forming apparatus 1. The control unit 60 includes an image processing unit 61, a non-image region extraction unit 62, a cleaning control unit 63, a storage unit 64, and the like. The control unit 60 includes a central processing unit (CPU), a read only memory (ROM), a random access memory (RAM), and the like.

Under the control of the control nit 60, the operation panel 70 displays various information and accepts various operations.

The image reading unit 80 reads an image of a document.

The image forming apparatus 1 rotates the photosensitive drum 25 to charge a surface of the photosensitive drum 25 with the charging roller 26. The image forming apparatus 1 exposes the charged surface of the photosensitive drum 25 in accordance with a separation signal for each color of image data by the exposure apparatus 27 to form an electrostatic latent image on the surface of the photosensitive drum 25.

Next, the image forming apparatus 1 supplies a toner from the developing apparatus 28 to the photosensitive drum 25 on which the electrostatic latent image has been formed, develops the toner image, and forms a toner image on the surface of the photosensitive drum 25.

Next, the image forming apparatus 1 sequentially transfers the toner image formed on the photosensitive drum 25 to the surface of the intermediate transfer belt 22 by using the primary transfer roller 23 (primary transfer). In the case of a full-color image, a toner image obtained by composing toner images of each color of Y, M, C, and K is formed on the surface of the intermediate transfer belt 22.

Subsequently, the image forming apparatus 1 conveys the toner image formed on the surface of the intermediate transfer belt 22 to a position facing the secondary transfer roller 24 by rotating the intermediate transfer belt 22.

Meanwhile, in the image forming apparatus 1, the sheet M placed on the manual feed tray 16 or the sheet M accommodated in the sheet feed tray 11 is fed by the sheet feed roller 12 and conveyed by each of the plurality of conveyance rollers 13 along the conveyance path TR1 to a conveyance direction AR1. The image forming apparatus 1 corrects tilt of the sheet M by a resist roller pair 13*a* of the conveyance roller 13 and then guides the sheet M between the intermediate transfer belt 22 and tire secondary transfer roller 24. Then, the image knitting apparatus 1 transfers the toner image formed on the surface of the intermediate transfer belt 22 to the front side of the sheet M by the secondary transfer roller 24.

The image forming apparatus 1 guides the sheet M holding the toner image (unfixed image) to the fixing apparatus 30, and fixes the toner image on the front side of the sheet M by the fixing apparatus 30. Thereafter, the image forming apparatus 1 discharges the sheet M on which the toner image has been fixed, to the sheet discharge tray 15 by the sheet discharge roller 14.

In the case of duplex printing, the image forming apparatus 1 switches back the sheet M on which the toner image has been formed on the front side thereof with the discharge roller 14, and guides the sheet M into the conveyance path TR2. The image forming apparatus 1 conveys the sheet M in the conveyance direction AR1*a* and guides the sheet M again into the conveyance path TR1 from a merging position with the conveyance path TR2 provided on the downstream side of the secondary transfer roller 24 in the conveyance path Mt. Thereafter, the image forming apparatus 1 forms a toner image on the back side of the sheet M by the toner image forming unit 20, fixes the toner image on the back side of the sheet M by the fixing apparatus 30, and discharges the sheet M to the sheet discharge tray 15 by the sheet discharge roller 14.

The image formed by the image forming apparatus 1 may be an image based on a print signal received from an external apparatus or may be an image of a document read by the image reading unit 80.

As an example of the performance of the image forming apparatus 1, the process speed of the image forming apparatus 1 is 325 mm/sec, the printing speed in monochrome prating is 75 sheets min, and the printing speed in color printing is 65 sheets/min.

Figure 2:
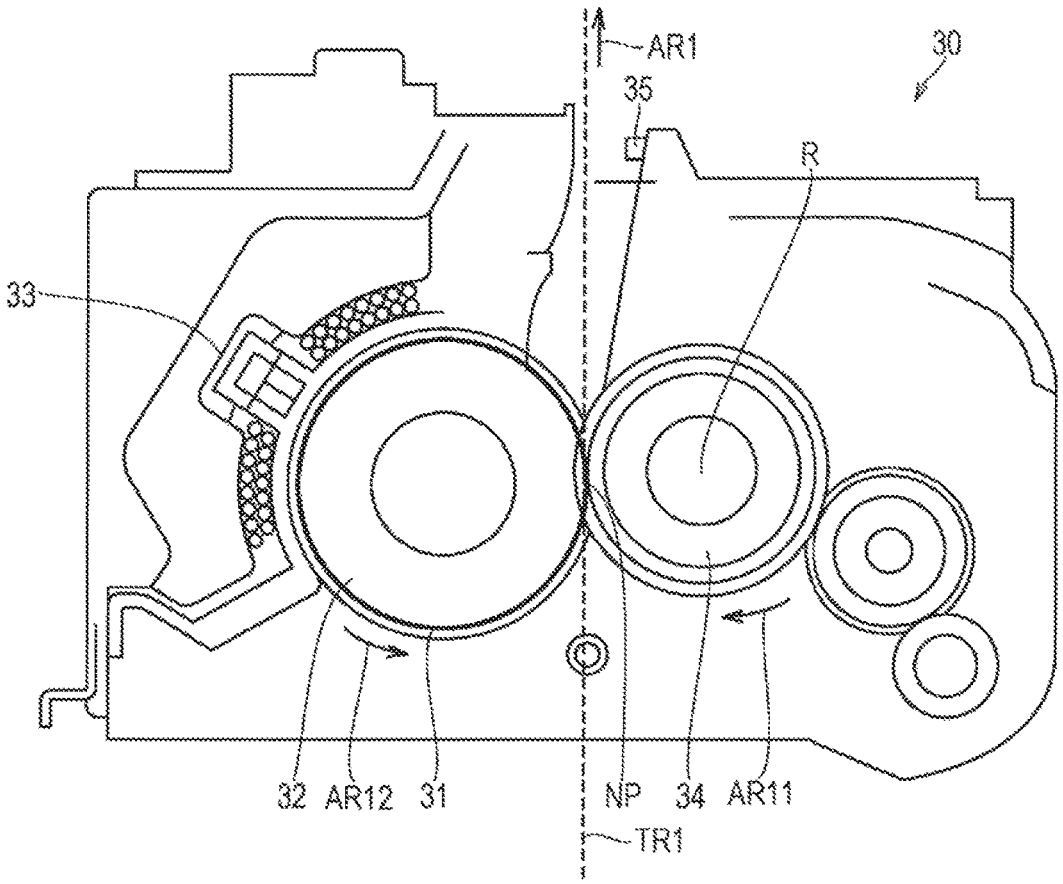
FIG. 2 is a cross-sectional view showing a configuration of a fixing apparatus according to the first embodiment of the present invention.

FIG. 2 is a cross-sectional view showing a configuration of the fixing apparatus 30 according to the first embodiment of the present invention.

Referring to FIG. 2, the fixing apparatus 30 is an external induction heating fixing apparatus, and includes a fixing belt 31 (an example of a heating member), a fixing roller 32, a heater 33, a pressure roller 34 (an example of pressure member), and a counter 35. The fixing apparatus 30 fixes the toner image on the sheet M by conveying the sheet M on which the toner image is formed, in the conveyance direction AR1 while gripping the sheet M with a fixing nip NP.

The fixing belt 31 is an endless thin-walled nickel (Ni) belt, and is wound around the outer circumference of the fixing roller 32. The fixing belt 31 includes, for example, a cylindrical nickel (Ni) layer having a thickness of 35 μm to 45 μm, a copper (Cu) layer provided on the outer circumference of the Ni layer and having a thickness of 9 μm to 11 μm, a Ni layer provided on the outer circumference of the Cu layer and having a thickness of 1 μm, a silicone rubber layer provided on the outer periphery thereof and having a thickness of 120 μm to 190 μm, and a release layer provided on the outer circumference of the silicone rubber layer with an adhesive layer interposed therebetween and formed of a fluororesin (PFA) tube having a thickness of 30 μm to 45 μm.

The fixing roller 32 has a cylindrical shape.

The heater 33 is an induction heating (IH) heater, and is provided in the vicinity of the fixing belt 31. The heater 33 generates a magnetic flux and heats the fixing belt 31 by induction heating.

The pressure roller 34 presses the fixing belt 31 to form the fixing nip NP between the pressure roller 34 and the fixing belt 31. The pressure roller 34 is pressed against the fixing roller 32 by pressure applier (not shown). The pressure roller 34 has a cylindrical shape and has a diameter of 40 mm. The pressure roller 34, includes a metal core having a hollow cylindrical shape and formed of metal, a silicone rubber layer provided on the outer circumference of the metal core with an adhesive layer interposed therebetween and having a thickness of 6 mm, a release layer provided on the outer circumference of the silicone rubber layer, formed of a PFA resin tube, and having a thickness of 40 μm, and a gear provided at one end along a central axis R of the pressure roller 34 and transmitting power to the pressure roller 34.

The pressure roller 34 is rotated in a direction indicated by an arrow AR11 by power from a drive source (not shown). The fixing belt 31 and the fixing roller 32 rotate in a direction indicated by an arrow AR12 following the pressure roller 34.

The counter (discharge mechanism sensor) 35 is provided, for example, on the downstream side of the fixing nip NP. The counter 35 counts the number of sheets passing through the fixing nip NP.

Figure 3A:
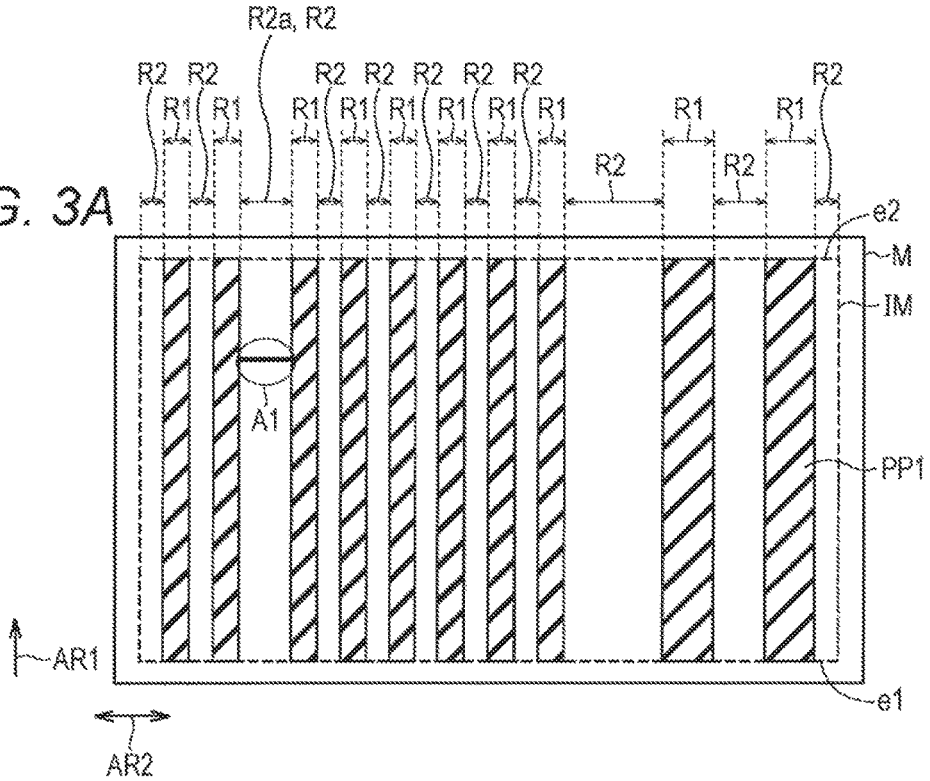
FIGS. 3A and 3B are diagrams schematically showing image regions and non-image regions in an image formed on a front side of a sheet.
Figure 3B:
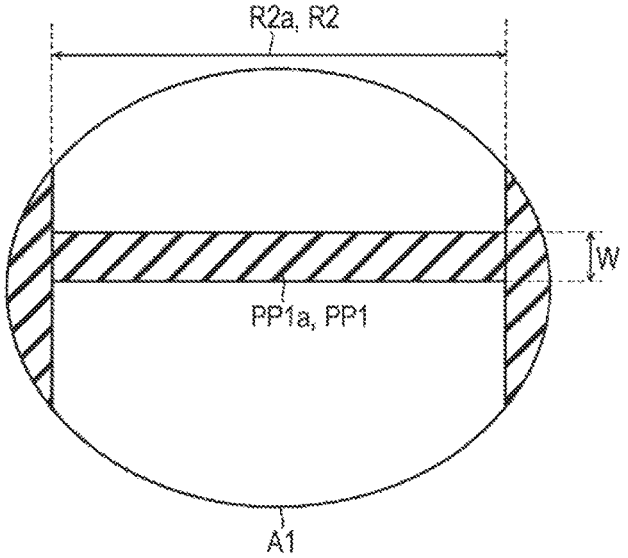

FIGS. 3A and 3B are diagrams schematically showing an image region R1 and a non-image region R2 in an image IM formed on the front side of the sheet M. FIG. 3A is an overall view of the image IM. FIG. 3B is an enlarged view of an A1 portion in the image IM.

Referring to FIGS. 3A and 3B, in the following description, unless otherwise specified, it is assumed that an image is formed on the front side of the sheet and no image is formed on the back side of the sheet. The image IM includes a region (the thick hatched region) where a toner image PP1 such as characters, figures, lines, or the like is formed in macroscopically view and a region (the region of a color of a sheet that is a base) where a toner image is not formed.

The image IM formed on the front side of the sheet M is divided into the image region R1 and the non-image region R2. The image region R1 is a region extending along the conveyance direction AR1 from an upstream side end e1 in the conveyance direction AR1 in the image IM to a downstream side end e2 in the conveyance direction AR1, and including a toner image PP1 having a length of equal to or larger than a first value (for example, 40 to 60 mm) in the conveyance direction AR1.

The non-image region R2 is a region extending along the conveyance direction AR1 from an upstream side end e1 in the conveyance direction MU in the image MI to a downstream side end e2 in the conveyance direction AR1, and not including a toner image PP1 having a length of equal to or larger than a first value in the conveyance direction AR1.

Here, the region R2*a* in the image IM is a region extending along the conveyance direction AR1 from the upstream side end et in the conveyance direction AR1 in the image IM to the downstream side end e2 in the conveyance direction AR1. The region R2*a* includes a toner image PP1*a* that is a part of the toner image PP1. A length W (an example of the first value) of the toner image PP1*a* in the conveyance direction AR1 is less than the first value. Therefore, the region R2*a* is classified as the non-image region R2.

It should be noted that the non-image region R2 may be defined as a region extending along the conveyance direction AR1 from an upstream side end e1 in the conveyance direction AR1 in the image IM to a downstream side end e2 in the conveyance direction AR1, and not including a toner image at all. In this case, the region R2*a* is classified as the image region R1 instead of the non-image region R2.

In the image IM, the image region R1 and the non-image region R2 are alternately arranged along a longitudinal direction AR2 of the fixing nip NP. The longitudinal direction AR2 of the fixing nip NP is a direction orthogonal to the conveyance direction AR1.

The inventors of the present application found that a phenomenon in which stains adhere to both sides of a sheet and image quality deteriorates occurs in a case where toner images of a plurality of images including non-image regions R2 overlapping each other (the plurality of images in this case may be identical images or images different from each other) are consecutively fixed by the fixing apparatus 30.

Figure 4:
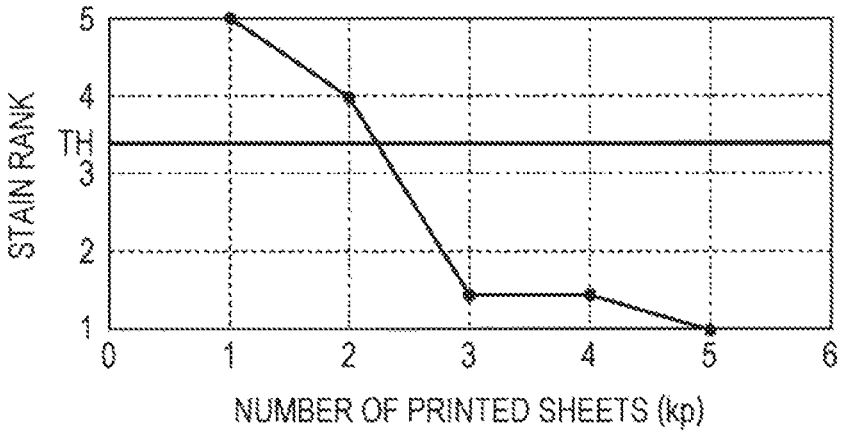
FIG. 4 is a diagram showing a change in stain rank of a back side of a sheet due to an increase in the number of printed sheets when a plurality of identical images including the non-image regions are consecutively printed on front sides of 5000 sheets.
Figure 5:
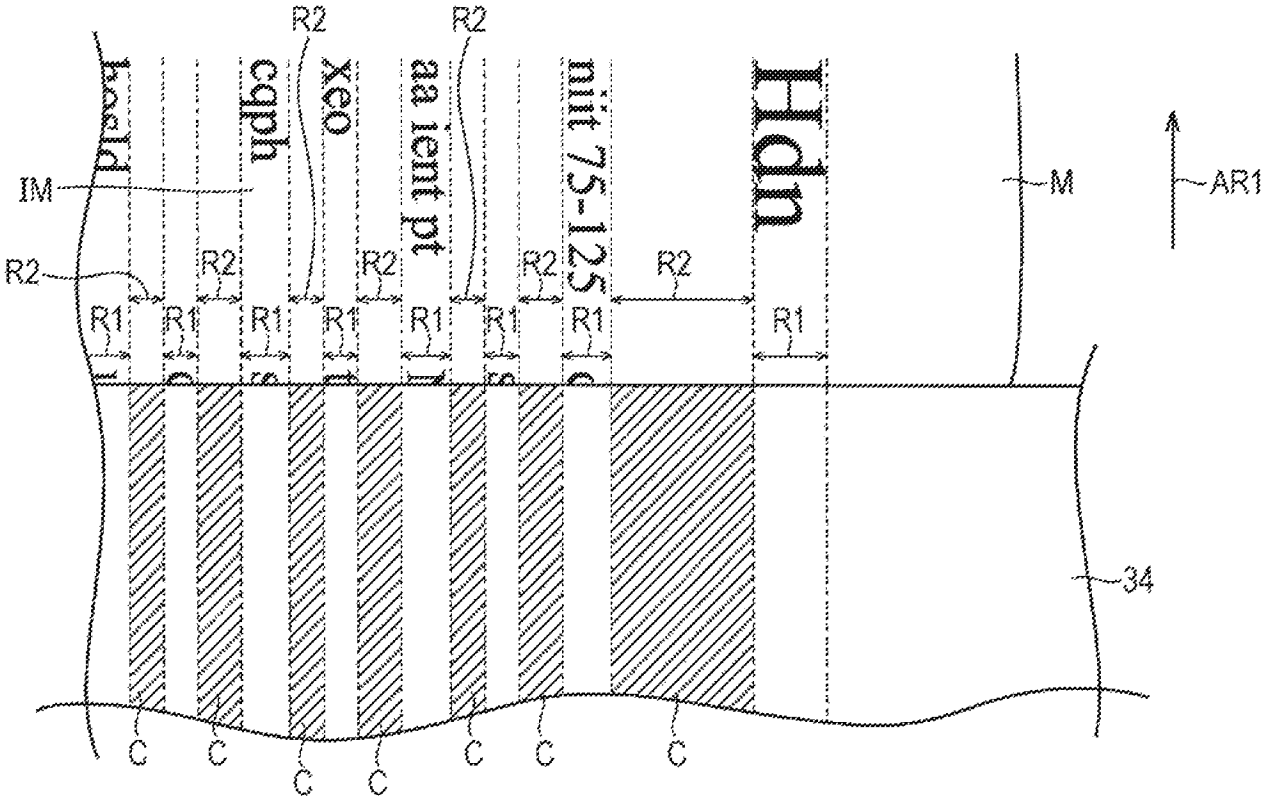
FIG. 5 is a diagram showing a positional relationship between a stain on a front side of a pressure roller and the image regions and the non-image regions after consecutive printing of a plurality of identical images including the non-image regions on 5000 sheets.

FIG. 4 is a diagram showing a change in stain rank of the back side of the sheet due to an increase in the number of printed sheets when a plurality of identical images including the non-image region R2 are consecutively printed on front sides of 5000 sheets. In FIGS. 4 and 5, used as the sheet M is a A4 size sheet having a basis weight of 75 g/m$^2$, and the proportion of calcium carbonate contained in the ash content after sheet roasting is 20% to 22%.

Referring to FIG. 4, the stain rank of the sheet is determined by visually comparing the stains of the sheet to be measured with the stains of a reference paper. The larger the number of the stain rank is, the less stains are, and the smaller the number of the stain rank is, the more the stains become severe. As a result of printing a plurality of identical images including non-image areas consecutively, the sheets printed on the 1000th and 2000th sheets have less stains than a threshold TH (here, the stain rank of "3.5") that is an acceptable level of stain. On the other hand, the sheets printed on the 3000th, 4000th and 5000th sheets have the stain ranks of 2 or less, which is lower than the threshold value TH, and the stain became more severe than the acceptable level.

FIG. 5 is a diagram showing a positional relationship between a stain on a surface of the pressure roller 34 and the image region R1 and the non-image region R2 after consecutive printing of a plurality of identical images including the non-image region R2 on 5000 sheets. In FIG. 5, the image region R1 includes alphabets, numerals, symbols, and the like.

Referring to FIG. 5, it is the fixing belt 31 that directly contacts with the front side of the sheet M (the surface on which the image IM is formed on the sheet M) when the sheet M passes through the fixing nip NP, and the pressure roller 34 contacts with the back side of the sheet M (the surface on which the image IM is not formed on the sheet M). When the surface of the pressure roller 34 was observed after a plurality of identical images IM including the non-image region R2 were consecutively printed on 5000 sheets, although the pressure roller 34 did not contact with the image IM, stains are generated remarkably in a region C (thin hatched region) of the surface of the pressure roller 34 corresponding to the non-image region R2.

FIGS. 6A to 6D are diagrams schematically showing the principle that stains are generated on the pressure roller 34 and the sheet M.

Figure 6A:
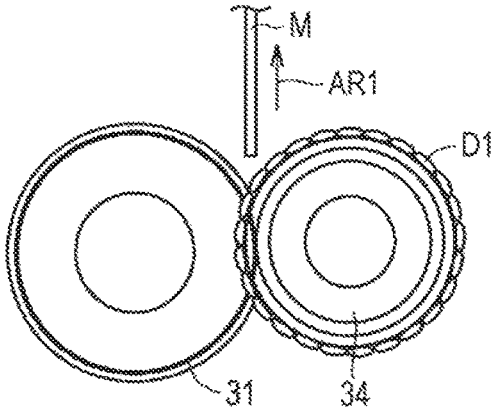
FIGS. 6A to 6D are diagrams schematically showing the principle that stains are generated on the pressure roller and the sheet.
Figure 6B:
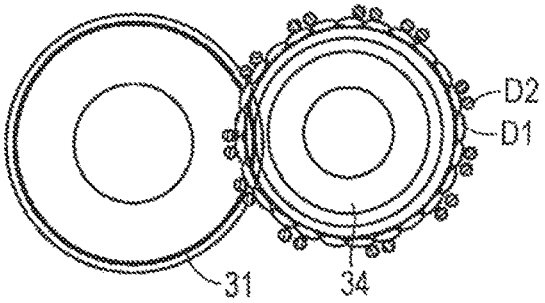
Figure 6C:
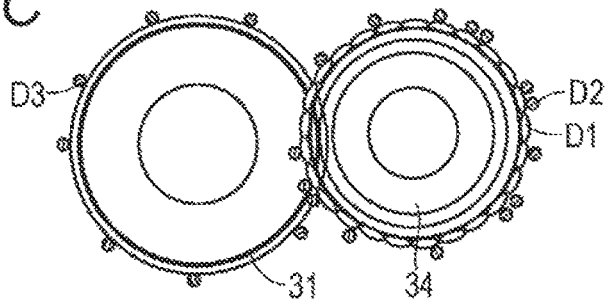
Figure 6D:
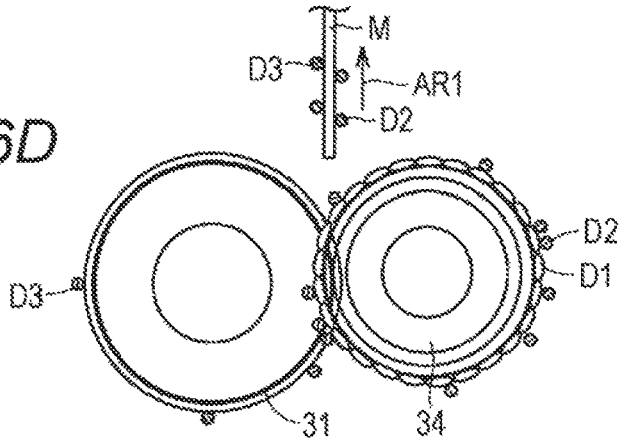

Referring to FIGS. 6A to 6D, the inventor of the present invention presumes the principle of generation of stains on the pressure roller 34 and the sheet M as follows. When toner images of a plurality of images including the non-image region R2 overlapping each other are consecutively fixed by the fixing apparatus 30, a sheet dust D1 generated from the sheet M adheres to the region corresponding to the non-image region R2 on the surface of the pressure roller 34 (FIG. 6A). A fogging toner D2 adhered to the back side of the sheet M adheres to the sheet dust D1 (FIG. 6B). In particular, since the temperature of the pressure roller 34 is lower than that of the fixing belt 31, the fogging toner D2 is easily transferred to the sheet dust D1 on the pressure roller 34. Apart of the fogging toner D2 moves to the surface of the fixing belt 31 when the pressure roller 34 contacts with the fixing belt 31 at the fixing nip NP, and becomes a fogging toner D3 (FIG. 6C). Thereafter, when the sheet M passes through the fixing nip NP, a part of the fogging toner D2 is transferred to the back side of the sheet M, and a part of the fogging toner D3 is transferred to the front side of the sheet M. Stains due to the fogging toners D2 and D3 are generated on both sides of the sheet M, and the image quality deteriorates (FIG. 6D).

When toner images of n images (n is an integer of 2 or more) including non-image regions overlapping each other are consecutively fixed by the fixing apparatus 30, the image forming apparatus 1 supplies the cleaning sheet to the fixing nip NP with its front side facing the pressure roller 34 by using the sheet conveyance unit 10 (an example of a supplier) so that the image quality degradation described above is prevented.

Figures 7A, 7B, 7C:
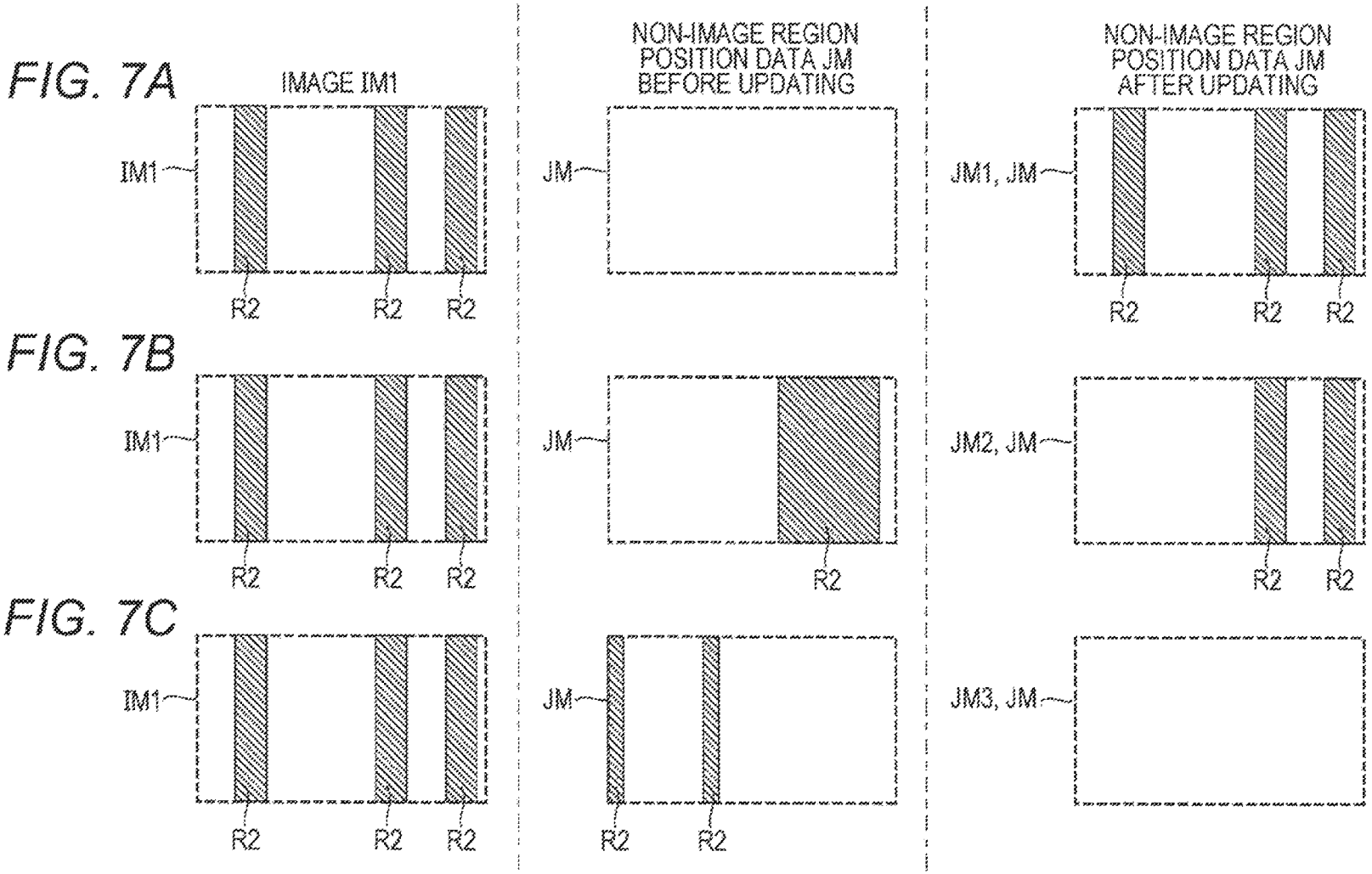
FIGS. 7A to 7C are diagrams schematically showing non-image region position stored in a storage unit in the first embodiment of the present invention.

FIGS. 7A to 7C are diagrams schematically showing non-image region position data JM stored in the storage unit 64 in the first embodiment of the present invention.

Referring to FIGS. 1 and 7A, the image forming apparatus 1 detects that toner images of n images including non-image regions overlapping each other are consecutively fixed by the fixing apparatus 30, by the following method. The storage unit 64 stores non-image region position data JM that is data indicating positions of overlapping non-image regions in images printed in the past. In the present embodiment, upon receiving a print signal (print job) from an external apparatus, an image reading apparatus, or the like, the image processing unit 61 performs raster image processor (RIP) processing to generate raster data of the image IM1 of the print job. The non-image region extraction unit 62 extracts the non-image region R2 from the raster data of the image IM1 of the print job. Note that the non-image region extraction unit 62 may extract the non-image region R2 from the image IM1 of the print job on the basis of the potential of the surface of the photosensitive drum 25 after exposure.

When the non-image region indicated by the non-image region position data JM does not exist (in the case where there is no overlapping non-image region in the most recently printed images), the non-image region extraction unit 62 stores the extracted non-image region R2 of the image IM1 as new non-image region position data JM1 in the storage unit 64 (updating the non-image region position data JM to the non-image region position data JM1).

Referring to FIGS. 1 and 7B, when the non-image region indicated by the non-image region position data JM exists (in the case where there is overlapping non-image regions in the past printed images), the non-image region extraction unit 62 determines the presence of overlapping portions of the newly extracted non-image region R2 of the image IM1 and the non-image region R2 indicated by the non-image region position data JM. When there is an overlapping portion, the non-image region extraction unit 62 stores the overlapping portion as new non-image region position data JM2 in the storage unit 64 (the non-image region position data JM is updated as the non-image region position data JM2).

Referring to FIGS. 1 and 7C, when there is no overlapping portion, the non-image region extraction unit 62 clears the non-image region position data JM (updates the non-image region position data JM to non-image region position data JM3 not including the non-image region R2), and clears the count value of the counter 35. As a result, when the toner image of the image not including the overlapping portion of the non-image region R2 stored in the non-image region position data JM is fixed by the fixing apparatus 30, the sheet conveyance unit 10 does not supply the cleaning sheet to the fixing nip NP.

The fact that the count value of the counter 35 reaches n sheets means that toner images of n images including non-image regions overlapping each other are consecutively fixed by the fixing apparatus 30. When the count value of the counter 35 reaches a sheets, the cleaning control unit 63 (an example of the image former) forms the cleaning image on the front side of the sheet on the basis of the non-image region position data JM stored in the storage unit 64, thereby making a cleaning sheet. The cleaning control unit 63 clears the count value of the counter 35. The sheet conveyance unit 10 switches back the made cleaning sheet with the discharge roller 14 and conveys the cleaning sheet along the conveyance path TR2, thereby reversing the front and back sides of the cleaning sheet and guiding the cleaning sheet again to the conveyance path TR1. As a result, the cleaning sheet is supplied to the fixing nip NP while the front side of the cleaning sheet (the surface on which the cleaning image is formed) faces the pressure roller 34.

Figure 8A:
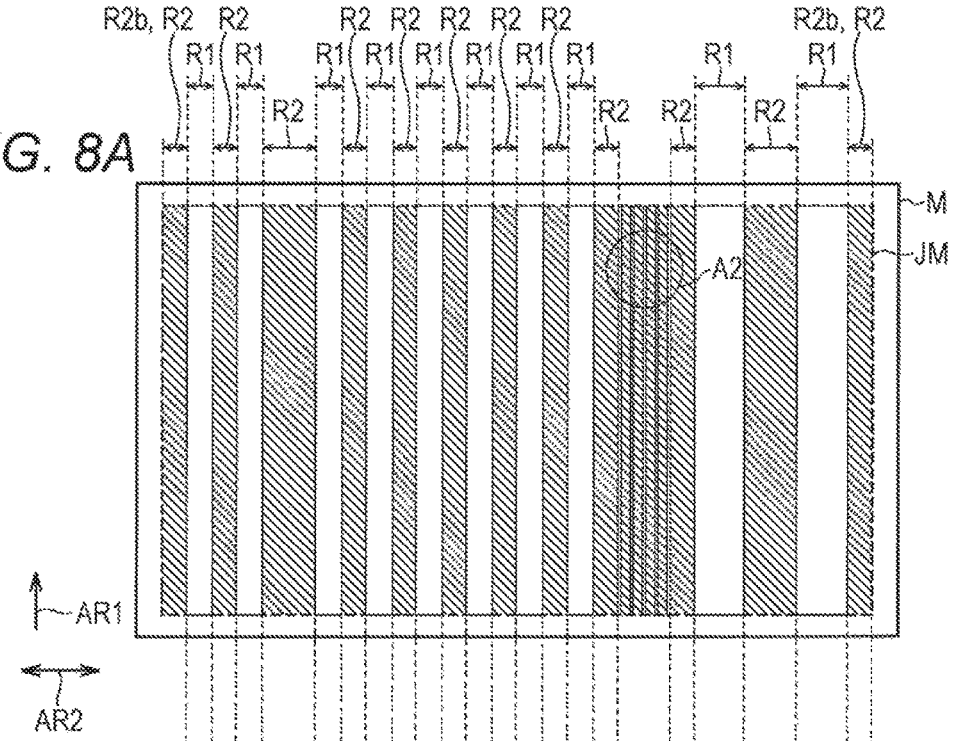
Figure 8B:
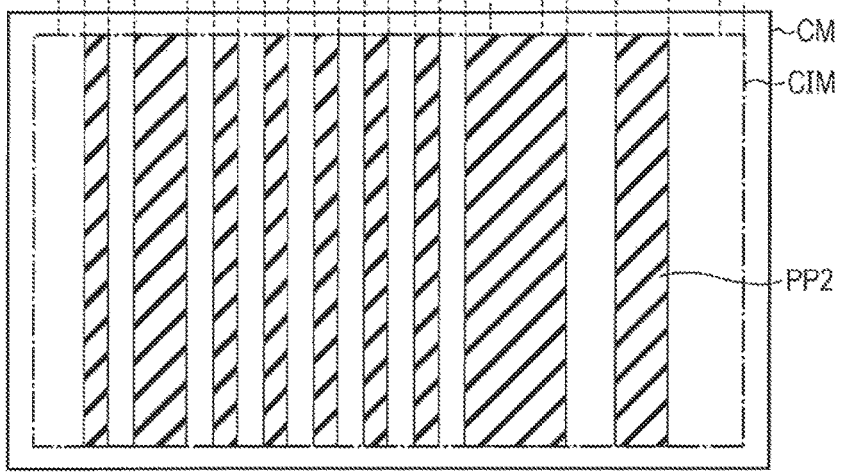
Figure 9:
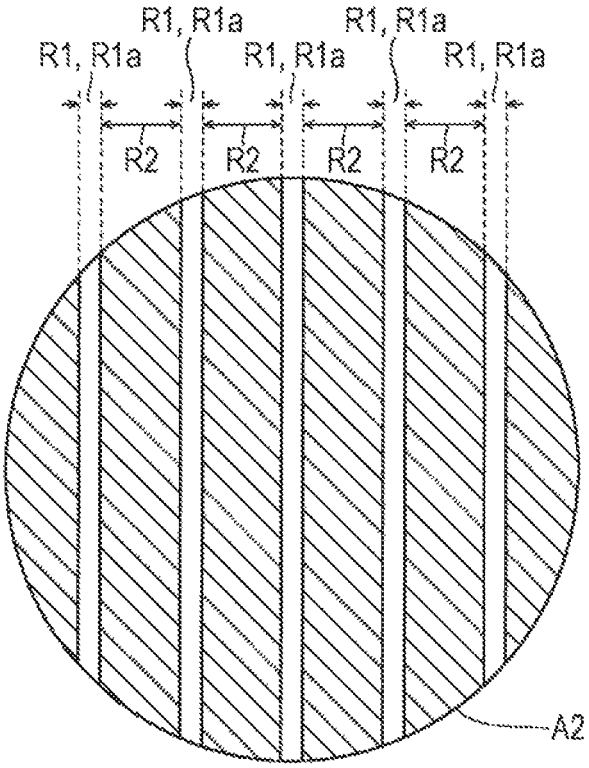
FIG. 9 is an enlarged view of a part A2 in FIG. 8A.

FIGS. 8A and 8B are diagrams showing an example of a relationship between the non-image region position data JM and a cleaning image CIM of a cleaning sheet CM. FIG. 8A shows the non-image region position data JM. FIG. 8B shows the cleaning image CIM formed on the cleaning sheet CM. FIG. 9 is an enlarged view of a part A2 in FIG. 8A.

Referring to FIGS. 8A and 8B, the length of the fixing nip NP in the longitudinal direction AR2 of the cleaning sheet CM is the maximum length that can be conveyed to the fixing apparatus 30. The toner image PP2 (the thick hatched region) included in the cleaning image CIM basically extends along the conveyance direction AR1 in a region corresponding to the non-image region R2 of the non-image region position data JM. It is preferable that the toner image PP2 included in the cleaning image CIM is a solid image having a toner adhesion amount of about 1.2 times the adequate toner adhesion amount (toner adhesion amount of about 4.8 g/m$^2$).

As an exceptional handling of the toner image PP2 included in the cleaning image CIM, a plurality of image regions Rth having a length of the fixing nip NP of equal to or less than L1 in the longitudinal direction AR2 exist in the A2 part in the non-image region position data JM (FIG. 9). It is preferable that the toner image PP2 included in the cleaning image CIM is formed in a region corresponding to the plurality of image regions R1*a* having a length of the fixing nip NP of equal to or less than the length L1 in the longitudinal direction AR2, in addition to the region corresponding to the non-image region R2 of the non-image region position data JM. This is because the possibility of stain generation is high in the region of the surface of the pressure roller 34 corresponding to the image region R1*a*. The length L1 is, for example, 47 dots, preferably 36 dots. When the resolution of the non-image region position data JM is 600 dpi×600 dpi, the length per dot corresponds to 42 μm.

As an exceptional handling of the toner image PP2 included in the cleaning image CIM, a non-image region R2*b* exists in an end portion of the fixing nip NP in the longitudinal direction AR2 in the image region of the non-image region position data JM. The toner image PP2 included in the cleaning image CIM may not be formed in the region corresponding to the non-image region R2*b*. This is because the possibility of stain generation is low in the region of the surface of the pressure roller 34 corresponding to the non-image region R2*b*.

It should be noted that the toner image PP2 included in the cleaning image CIM is not limited to the case of being formed in the region determined by the method described with reference to FIGS. 8A and 8B. Any case is applied as long as the toner image PP2 extends along the conveyance direction AR1 at least in a part of the region corresponding to the non-image regions overlapping each other of the n sheets of images described above.

Figure 10A:
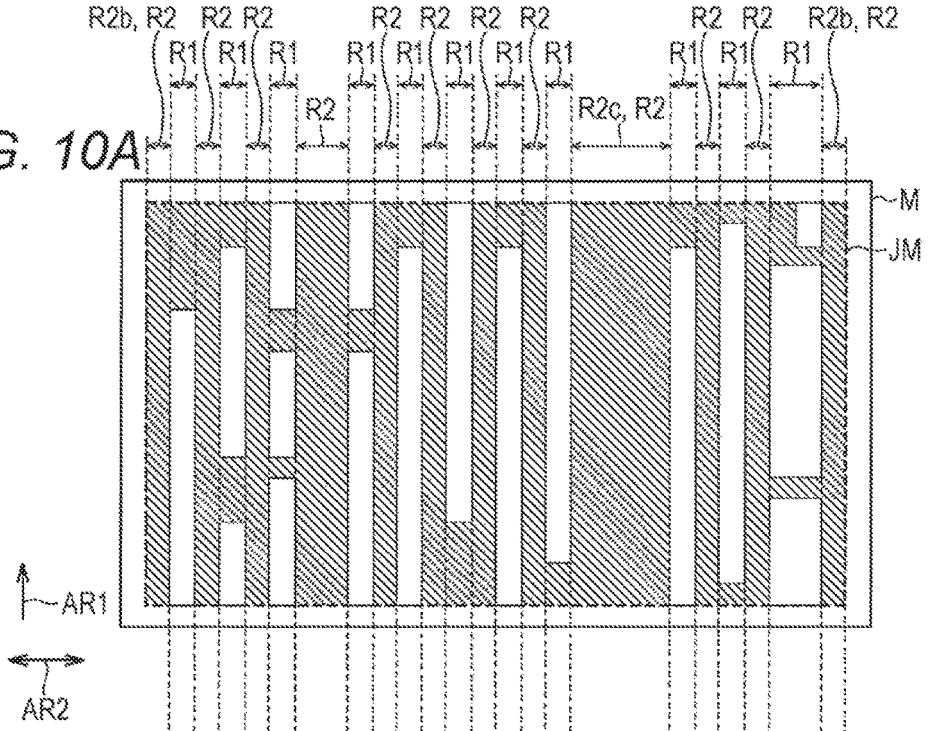
FIGS. 10A and 10B are diagrams showing another example of a relationship between the non-image region position data and the cleaning image of the cleaning sheet.
Figure 10B:
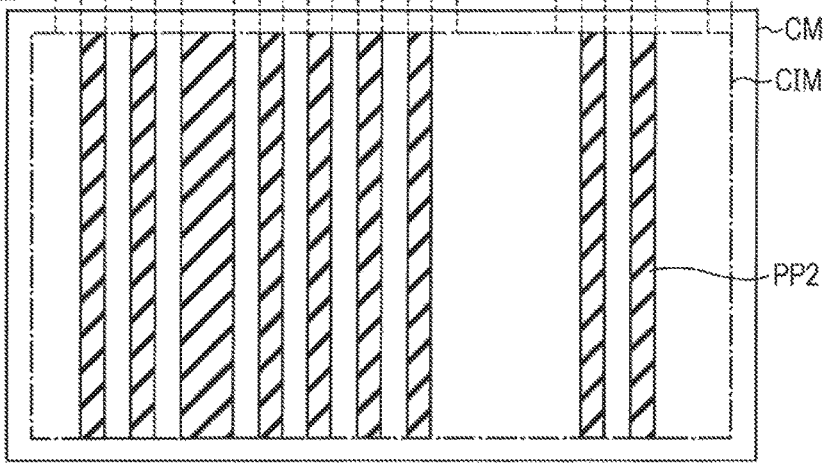

FIGS. 10A and 10B are diagrams showing another example of a relationship between the non-image region position data JM and the cleaning image CIM of the cleaning sheet CM. FIG. 10A shows the non-image region position data JM. FIG. 10B shows the cleaning image CIM formed on the cleaning sheet CM.

Referring to FIGS. 10A and 10B, a case is assumed where there is a non-image region R2*c* having a length of the fixing nip NP of equal to or longer than the length L2 (an example of the second value) in the longitudinal direction AR2 in the non-image region position data JM. The toner image PP2 included in the cleaning image CIM may not be formed in the region corresponding to the non-image region R2*c*. This is because the possibility of stain generation is low in the region of the surface of the pressure roller 34 corresponding to the non-image region R2*c*. The length L2 is, for example, 360 dots.

As shown in FIG. 8A and FIG. 10A, an image including a toner image aligned in the conveyance direction AR1 (for example, a character image including a character string extending in the conveyance direction AR1) has a space between toner images, and there is a high possibility that the image includes the non-image region R2. Therefore, when toner images of a plurality of images including toner images aligned in the conveyance direction AR1 and including the non-image region R2 overlapping each other are consecutively fixed by the fixing apparatus 30, the image forming apparatus 1 may supply the cleaning sheet to the fixing nip NP.

Figure 11:
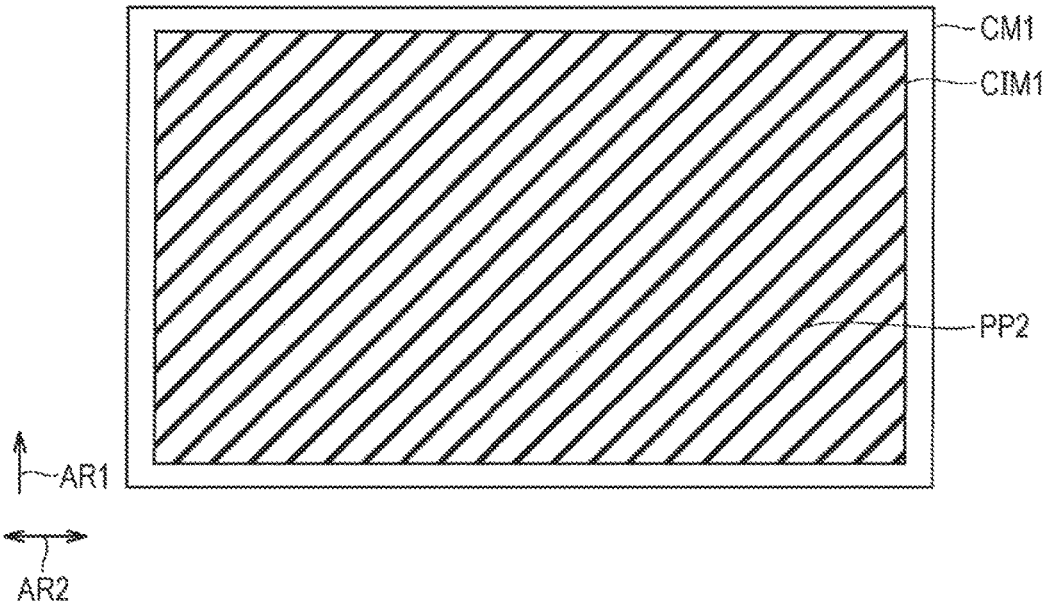
FIG. 11 is a diagram showing a cleaning sheet on which a cleaning image being a solid image is formed.

FIG. 11 is a diagram showing a cleaning sheet CM1 on which a cleaning image CIM1 being a solid image is formed.

Referring to FIG. 11, when the toner images of n sheets of identical images including the non-image region R2 are consecutively fixed by the fixing apparatus 30, the cleaning control unit 63 may make the cleaning sheet CM1 by uniformly forming the cleaning image CIM1 as shown in FIG. 11 on the front side of the sheet without being based on the non-image region position data JM. The length of the fixing nip NP in the longitudinal direction AR2 of the cleaning sheet CIM is the maximum length that can be conveyed to the fixing apparatus 30. The cleaning image CIM1 is a solid image, and the toner image PP2 included in the cleaning image CIM1 is formed on the entire image forming region of the cleaning, sheet CM1. The cleaning image CIM1 has a toner adhesion amount of about 1.2 times the adequate toner adhesion amount (toner adhesion amount of about 4.8 g/m$^2$). In this case, since the image forming apparatus 1 always forms the identical cleaning images CIM1 without based on the non-image region position data JM, the process performed by the image forming apparatus 1 can be simplified.

Figure 12:
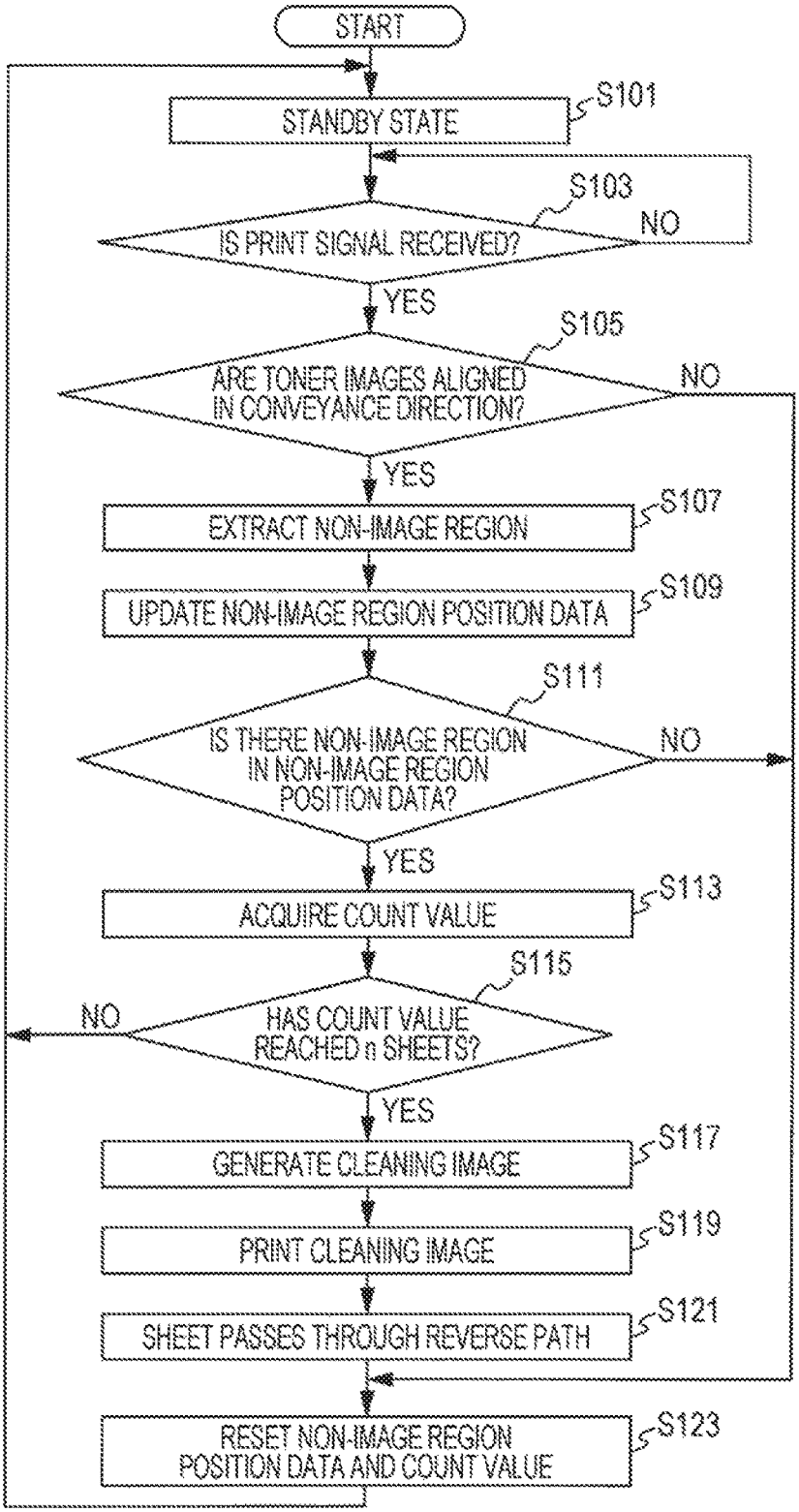
FIG. 12 is a flowchart showing operation of the image forming apparatus according to the first embodiment of the present invention.
Figure 13:
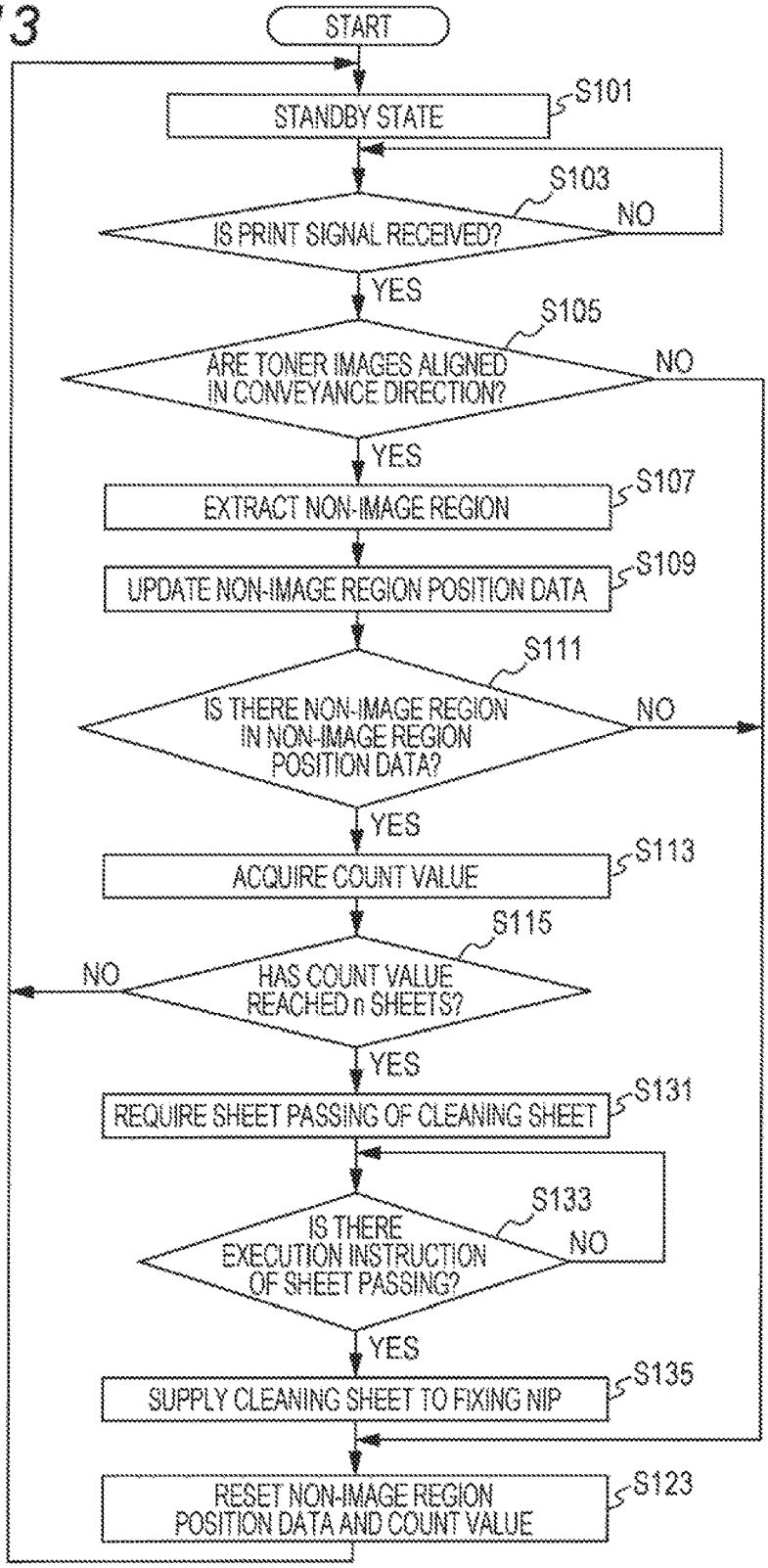
FIG. 13 is a flowchart showing operation of the image forming apparatus according to a second embodiment of the present invention.

FIG. 12 is a flowchart showing operation of the image forming apparatus 1 according to the first embodiment of the present invention. The flowcharts of FIGS. 12 and 13 are realized by the CPU executing the control program stored in the ROM.

Referring to FIG. 12, in the standby state (S101), the control unit 60 determines whether a print signal has been received (S103). Until it is determined that the print signal has been received, the control unit 60 repeats the process of step S103.

In step S103, when it is determined that a print signal has been received (YES in S103), the control unit 60 determines whether the image based on the print signal is an image including toner images aligned in the conveyance direction (S105).

If it is determined in step S105 that the image based on the print signal is an image including toner images aligned in the conveyance direction (YES in S105), the control unit 60 extracts a non-image region from the image (S107), and updates non-image region position data on the basis of the extracted non-image region (S109). Subsequently, the control unit 60 determines whether a non-image region is included in the updated non-image region position data (S111).

If it is determined in step S105 that the image based on the print signal is not an image including toner images aligned in the conveyance direction AR1 (NO in S105), or if it is determined in step S111 that the non-image region position data JM after updating does not include a non-image region (NO in S111), the control unit 60 proceeds to the process of step S123.

If it is determined in step S111 that a non-image region is included in the updated non-image region position data (YES in S111), the control unit 60 acquires the count value from the counter 35 (S113), and determines whether the count value has reached n (sheets) (S115).

In step S115, if it is determined that the count value has not reached n (sheets) (NO in S115), the control unit 60 proceeds to the processing in step S101.

In step S115, if it is determined that the count value has reached n (sheets) (YES in S115), the control unit 60 generates a cleaning image based on the non-image region indicated by the non-image region position data (S117). Next, the control unit 60 prints the generated cleaning image on the sheet to prepare the cleaning sheet (S119), and discharges the cleaning sheet through a reverse path (conveyance path TR2) (S121). Thereafter, the control unit 60 clears the non-image region position data and the count value (S123), and proceeds to the processing of step S101.

According to the present embodiment, when the cleaning sheet on which the cleaning image is formed is supplied to the fixing nip NP, the fogging toner and the sheet dust adhered to the surface of the pressure roller 34 are moved to the cleaning sheet by the adhesive force of the cleaning image and is removed. As a result, stains of the pressure roller 34 can be removed, stains of the sheet can be suppressed, and deterioration of image quality can be suppressed. Since it is unnecessary to provide a cleaning member for a new pressure roller 34, so complication of the apparatus configuration can be avoided.

In JP 2012-133034 A, a cleaning image pattern is formed in a blank portion at a predetermined timing irrespective of whether or not a plurality of printed images include non-image regions overlapping each other. For this reason, a cleaning image pattern different from the image desired by the user is formed in the blank space at unnecessary timing on a sheet, and it is impossible to sufficiently prevent deterioration of the image quality.

Second Embodiment

Referring to FIG. 1, in the image forming apparatus 1 of the present embodiment, when toner images of n sheets of images including non-image regions overlapping each other are consecutively fixed by the fixing apparatus 30, the operation panel 70 (an example of a requester) displays a message for requesting the placement of the cleaning image on the manual feed tray 16 (an example of the placing unit).

When viewing the message displayed on the operation panel 70, the user of the image forming apparatus 1 places the cleaning sheet CRM (FIG. 11) prepared (printed) in advance on the manual feed tray 16. At this time, the cleaning sheet CM1 is placed in a manner of being supplied to the fixing nip NP while the front side of the cleaning sheet CM1 (the surface on which the cleaning image CIM1 is formed) faces the pressure roller 34.

Upon receipt of an execution instruction of sheet passing through the operation panel 70, the sheet conveyance unit 10 supplies the cleaning sheet CM1 placed on the manual feed tray 16 to the fixing nip NP along the conveyance path TR1, and then discharges the sheet to the sheet discharge tray 15. The front side of the cleaning sheet CM1 is supplied to the fixing nip NP While facing the pressure roller 34. No new image is formed on the cleaning sheet CM1.

FIG. 13 is a flowchart showing operation of the image forming apparatus 1 according to a second embodiment of the present invention.

Referring to FIG. 13, this flowchart is different from the flowchart of the first embodiment shown in FIG. 12 in the processing after it is determined to YES in the processing of step S115.

If it is determined in step S115 that the count value has reached n (sheets) (YES in step S115), the control unit 60 causes a message requesting sheet passing of the cleaning sheet to be displayed (S131), and determines whether an execution instruction of sheet passing of the cleaning sheet has been accepted (S133). The control unit 60 repeats the processing of step S133 until it is determined, that the execution instruction of sheet passing of the cleaning sheet has been accepted.

If it is determined in step S133 that execution instruction of sheet passing of the cleaning sheet has been accepted (YES in step S133), the control unit 60 supplies the cleaning sheet to the fixing nip NP (S135). Thereafter, the control unit 60 clears the non-image region position data and the count value (S123), and proceeds to the processing of step S101.

The configuration and operation of the image forming apparatus 1 other than the above is similar to the configuration and operation of the image forming apparatus according to the first embodiment, so description thereof will not be repeated.

According to this embodiment, as in the first embodiment, degradation of image quality can be suppressed. In addition, stains of the pressure roller 34 can be removed, stains of the sheet can be suppressed, and deterioration of image quality can be suppressed by simple processing of displaying a message.

Modification

When the n sheets of identical images including the non-image region R2 are consecutively fixed by the fixing apparatus 30, the image forming apparatus 1 may supply the cleaning sheet to the fixing nip NP. In this case, the image forming apparatus 1 only has to count the number of times of fixing the identical images, and it is not necessary to extract the non-image region R2 from the image each time the printing signal is received, and the processing performed by the image forming apparatus 1 can be simplified.

The control unit 60 may set the temperature of the fixing apparatus 30 of when the cleaning sheet is grasped with the fixing nip NP to be higher (for example, about 15 degrees higher) than the temperature of the fixing apparatus 30 of when toner images of a plurality of images IM including non-image regions overlapping each other are fixed. This increases the adhesive force of the cleaning image and makes it easy to remove fogging toner and sheet dust adhered to the surface of the pressure roller 34.

The control unit 60 may set the sheet passing speed of the fixing apparatus 30 of when the cleaning sheet is grasped with the fixing nip NP to be slower (for example, about half speed) than the sheet passing speed of the fixing apparatus 30 of when toner images of a plurality of images including non-image regions overlapping each other are fixed. This increases time of contacting of the cleaning image with the pressure roller 34 and makes it easy to remove fogging toner and sheet dust adhered to the surface of the pressure roller 34.

The fixing apparatus has any configuration as long as including a heating member that is heated by a heater and a pressing member that forms a fixing nip between the pressing member and the heating member by pressing the heating member. The fixing apparatus may include, for example, a fixing belt (an example of the heating member) stretched between a heating belt and a pad and heated by a heater provided inside the heating belt, and a pressure roller (an example of the pressure member) that forms a fixing nip between the pressure roller and the fixing belt by pressing the fixing belt. The heating member may be composed of a fixing roller, and the pressure member may be composed of a belt.

Others

The above-described embodiment and modifications can be appropriately combined.

The processing in the embodiment and the modifications described above may be performed by software or a hardware circuit. It is also possible to provide a program for executing the processing in the above-described embodiment, and the program may be recorded on a recording medium such as a CD-ROM, a flexible disk, a hard disk, a ROM, a RAM, a memory card, and provided to a user. The program is executed by a computer such as a CPU. The program may be downloaded to the apparatus via a communication line such as the Internet.

Although embodiments of the present invention have been described and illustrated in detail, the disclosed embodiments are made for purposes of illustration and example only and not limitation. The scope of the present invention should be interpreted not by the above description but by terms of the appended claims, and it is intended that all modifications within meaning and scope equivalent to the claims are included.

What is claimed is:

1. An image forming apparatus comprising:

a fixing apparatus comprising a heating member that is heated by a heater and a pressure member that forms a fixing nip between the pressure member and the heating member by pressing the heating member, the heating member and the pressure member extend in a longitudinal direction, the fixing apparatus being configured to convey a sheet on which a toner image is formed in a predetermined conveyance direction while gripping the sheet with the fixing nip to fix the toner image on the sheet, the conveyance direction is perpendicular to the longitudinal direction; and a supplier that, when a plurality of sheets, each of which includes a non-image region in a same location along the longitudinal direction, are consecutively fixed by the fixing apparatus, supplies a cleaning sheet on which a cleaning image is formed on one surface, to the fixing nip in a state where the one surface faces the pressure member, the cleaning image including a cleaning toner image at least in a part of the cleaning image corresponding to the same location along the longitudinal direction, wherein the non-image regions are regions extending along the conveyance direction from an upstream side end in the conveyance direction in an image to a downstream side end in the conveyance direction, and include at least one of:

a region in which a toner image has a length of less than a first predetermined value in the conveyance direction, and a region in which a toner image has a length of less than a second predetermined value in the longitudinal direction, and a region extending in the conveyance direction in which no toner image is formed, provided that the region in which no image is formed extends less than a third predetermined value, and wherein the cleaning toner image is interrupted in the longitudinal direction along the entire conveyance direction in regions that do not include non-image regions.

2. The image forming apparatus according to claim 1, wherein, when toner images of a plurality of identical images including the non-image regions are consecutively fixed by the fixing apparatus, the supplier supplies the cleaning sheet to the fixing nip.

3. The image forming apparatus according to claim 1, further comprising a counter that counts the number of sheets passing through the fixing nip, wherein, when the number of sheets counted by the counter reaches a predetermined number and a plurality of images formed on the predetermined number of sheets include the non-image regions overlapping each other, the supplier supplies the cleaning sheet to the fixing nip.

4. The image forming apparatus according to claim 3, wherein the counter clears the counted number when the cleaning sheet passes through the fixing nip.

5. The image forming apparatus according to claim 1, wherein the toner image included in the cleaning image extends along the conveyance direction at least in a part of a region corresponding to the non-image regions overlapping each other.

6. The image forming apparatus according to claim 1, wherein the toner image included in the cleaning image is not formed in a region corresponding to the non-image regions having a length of equal to or more than a second value in a direction orthogonal to the conveyance direction, among the non-image regions overlapping each other.

7. The image forming apparatus according to claim 1, wherein a length of the cleaning sheet in a direction orthogonal to the conveyance direction is a maximum length in which a sheet can be conveyed to the fixing apparatus, and the toner image included in the cleaning image is formed on an entire surface of an image forming region of the cleaning sheet.

8. The image forming apparatus according to claim 1, further comprising an image former that forms the cleaning image, wherein the supplier reverses a direction of the one surface of the cleaning sheet on which the cleaning image is formed by the image former, and supplies the cleaning sheet to the fixing nip.

9. The image forming apparatus according to claim 1, further comprising: a placing part on which the cleaning sheet is placed; and a requester that requests placement of the cleaning sheet on the placing part when toner images of a plurality of images including the non-image regions overlapping each other are consecutively fixed by the fixing apparatus, wherein the supplier supplies the cleaning sheet placed on the placing part to the fixing nip.

10. The image forming apparatus according to claim 1, wherein a temperature of the fixing apparatus when the cleaning sheet is gripped with the fixing nip is higher than a temperature of the fixing apparatus when the toner images of the plurality of images including the non-image regions overlapping each other are fixed.

11. The image forming apparatus according to claim 1, wherein a sheet passing speed of the fixing apparatus when the cleaning sheet is gripped with the fixing nip is slower than a sheet passing speed of the fixing apparatus when the toner images of the plurality of images including the non-image regions overlapping each other are fixed.

12. The image forming apparatus according to claim 1, wherein, when a toner image of an image not including the non-image regions overlapping each other is fixed by the fixing apparatus, the supplier does not supply the cleaning sheet to the fixing nip.

13. The image forming apparatus according to claim 1, wherein, when toner images of a plurality of images including toner images aligned in the conveyance direction and including the non-image regions overlapping each other are consecutively fixed by the fixing apparatus, the supplier supplies the cleaning sheet to the fixing nip.

14. A control method of an image forming apparatus, the image forming apparatus comprising a fixing apparatus comprising a heating member that is heated by a heater and a pressure member that forms a fixing nip between the pressure member and the heating member by pressing the heating member, the heating member and the pressure member extending in a longitudinal direction, the fixing apparatus being configured to convey a sheet on which a toner image is formed in a predetermined conveyance direction while gripping the sheet with the fixing nip to fix the toner image on the sheet, the conveyance direction is perpendicular to the longitudinal direction, the control method comprising, when a plurality of sheets, each of which includes a non-image region in a same location along the longitudinal direction, are consecutively fixed by the fixing apparatus, supplying a cleaning sheet on which a cleaning image is formed on one surface, to the fixing nip in a state where the one surface faces the pressure member, the cleaning image including a cleaning toner image at least in a part of the cleaning image corresponding to the same location along the longitudinal direction, wherein the non-image regions are regions extending along the conveyance direction from an upstream side end in the conveyance direction of an image to a downstream side end in the conveyance direction, and include at least one of:

a region in which a toner image has a length of less than a first predetermined value in the conveyance direction, and a region in which a toner image has a length of less than a second predetermined value in the longitudinal direction, and a region extending in the conveyance direction in which no toner image is formed, provided that the region in which no image is formed extends less than a third predetermined value, and wherein the cleaning toner image is interrupted in the longitudinal direction along the entire conveyance direction in regions that do not include non-image regions.

* * * * *